United States Patent [19]

Misra et al.

[11] 4,445,813

[45] May 1, 1984

[54] METHOD OF FORMING SEAMLESS CONTAINER

[75] Inventors: Surya K. Misra, Naperville; Richard A. Openchowski, Woodridge, both of Ill.

[73] Assignee: National Can Corporation, Chicago, Ill.

[21] Appl. No.: 48,667

[22] Filed: Jun. 14, 1979

Related U.S. Application Data

[63] Continuation of Ser. No. 851,856, Nov. 15, 1977, abandoned.

[51] Int. Cl.[3] ..... B21D 51/02

[52] U.S. Cl. ..... 413/1; 72/42

[58] Field of Search ..... 113/120 A, 120 H; 428/327, 340, 341, 411, 458; 252/56 S; 72/41, 46, 42; 413/1

[56] References Cited

U.S. PATENT DOCUMENTS

| | | | |
|---|---|---|---|
| 3,282,971 | 11/1966 | Metro et al. | 252/56 S |
| 3,478,554 | 11/1969 | Demsey | 113/120 A X |
| 3,577,753 | 5/1971 | Shah | 72/41 |
| 3,728,147 | 4/1973 | Jenkins et al. | 252/56 S X |
| 3,749,598 | 7/1973 | Kushima et al. | 428/341 X |
| 3,826,675 | 7/1974 | Smith et al. | 252/56 S X |
| 4,032,678 | 6/1977 | Perfetti et al. | 72/46 X |

*Primary Examiner*—Howard N. Goldberg

*Attorney, Agent, or Firm*—Robert A. Stenzel; Ralph R. Rath

[57] ABSTRACT

A precoated stock material for use in forming a drawn and ironed container and a method of forming such container is disclosed herein. The stock material initially has a layer of lubricant applied to one or both surfaces of the metal base with the lubricant consisting essentially of a fatty acid ester of a mono or polyhydric alcohol and having a distribution of less than 3 mg./in.$^2$. The method contemplates applying the layer of lubricant to a metal stock, such as aluminum, black plate or tinplate, cutting a disc from the metal stock, and transforming the disc into a drawn and ironed container without additional lubricant being applied to the tooling.

9 Claims, No Drawings

METHOD OF FORMING SEAMLESS CONTAINER

REFERENCE TO RELATED APPLICATION

This is a continuation of application Ser. No. 851,856, filed Nov. 15, 1977, now abandoned.

BACKGROUND OF THE INVENTION

The present invention relates generally to containers and more particularly to an improved stock material for making containers and a method for forming seamless drawn and ironed containers from the improved stock material.

The use of a two-piece container for packaging beer and/or carbonated beverages has become very popular in recent years. The two-piece container consists of a container sidewall or body that has a unitary end wall at one end thereof. The second piece for the container consists of an end which is seamed to the open end of the container.

In the formation of drawn and ironed containers, a finished container is produced by initially cutting a disc from a sheet or coil of stock material and substantially simultaneously transforming the disc into a shallow cup in a conventional cupping machine that forms part of a can manufacturing line. The shallow cup is then converted into a drawn and ironed container in a body maker wherein the shallow cup is reformed into a cup of different dimensions and then passed through a plurality of ironing rings that cooperate with a punch to decrease the wall thickness of the reformed cup and produce a seamless container. Alternatively, the cup may initially have a diameter substantially equal to the final diameter so that the reforming or redrawing in the body maker is not necessary.

In most commercial machinery utilized for forming the cups and then converting the cups to drawn and ironed containers, a lubricant-coolant is utilized in the cupper for providing the necessary lubricity between the surface of the stock material and the tooling. The body making machinery also incorporates mechanism for flowing a lubricant-coolant to the surface of the container and to the ironing dies utilized in cooperation with the punch. Conventionally, the lubricant-coolant consists of a mixture of water and a emulsified oil or emulsified synthetic lubricant, such as a commercially available Texaco 591 product.

One of the difficulties with utilizing the water soluble emulsified oils in the cupping as well as the drawing and ironing tooling is subsequent cleaning of the finished containers to remove the emulsified oils from the surfaces thereof. In order to produce an acceptable surface that can subsequently be coated and/or decorated, it is necessary to utilize harsh chemicals and washing temperatures as high as 160° F. to remove the undesired emulsified oils. Furthermore, it has been determined that some emulsified oils may become toxic which presents a potential health hazard.

SUMMARY OF THE INVENTION

It has been determined that all lubricants in the cooling fluid can be eliminated by applying a thin layer of an organic ester to the stock material before the cupping operation is initiated.

According to the present invention, a metal base of stock material that is to be used for forming a drawn and ironed seamless container first has a thin layer of lubricant applied to at least one surface of the metal stock or blank and a disc is cut from the metal blank and formed into a shallow cup without the use of any additional lubricant or coolant. The shallow cup is then further drawn and ironed to produce a seamless container which again is done without the use of any additional lubricant in the liquid coolant, such as water, in the drawing and ironing machine.

More specifically, the thin layer of lubricant consists essentially of a fatty acid ester of the mono or polyhydric alcohol and the layer has a distribution or thickness preferably less than 3 mg./in.$^2$.

It has been determined that applying a single layer of less than 3 mg./in.$^2$ of an organic ester to one surface only of black plate, tinplate or aluminum by a commercial lubricator eliminates the need for any subsequent lubrication in the cupping machine as well as the body maker.

DESCRIPTION OF THE INVENTION

In its broadest aspect, the present invention contemplates precoating a metal sheet or coil with a thin layer of lubricant to one surface only of the metal sheet or coil, cutting a disc from the metal sheet or coil with the lubricant applied to one surface, forming a shallow cup from the disc subsequently redrawing and ironing the shallow cup into a full sized container.

Stated another way, a stock material, such as an aluminum, black plate, or tinplate metal sheet or coil, has a layer of lubricant consisting essentially of a fatty acid ester of a mono or polyhydric alcohol applied to one surface of the stock material to a thickness of less than 3 mg./in.$^2$ and preferably about 1 mg./in.$^2$ and the pretreated stock material is then utilized in forming a seamless drawn and ironed container that has a bottom wall and an integral sidewall in conventional cupping and body making machinery that is presently utilized for making such containers. By applying the lubricant to the stock material before a disc is cut therefrom, all additional lubricants in the drawing and ironing process can be eliminated and it is only necessary to provide the body maker with a water coolant that has a small amount of rust inhibitor therein to maintain the tooling below a predetermined temperature.

One lubricant that is suitable for carrying out the present invention is a fatty acid ester of a mono or polyhydric alcohol. A commercially available lubricant of this type is produced by Mobil Chemical Company under the designation S-6661-003.

The Mobil lubricant was successfully applied to one surface of black plate, tinplate or aluminum plate by a lubricator to produce a thin layer of lubricant having a thickness or distribution of less than 3 mg./in.$^2$ on the surface of the stock material that ultimately becomes the inside of the container. If necessary to produce the desired thickness of the layer, it may be necessary to either thin the fatty acid ester with a solvent before it is applied to the surface of the stock material or simply by heating the material before it is applied by the lubricator. A further alternative form of heating would be to heat the rollers that form part of the lubricator.

EXAMPLE I

Laboratory tests were conducted by applying a layer of approximately 1.25 mg./in.$^2$ of the above Mobil lubricant on one surface of a sheet of tinplate stock material. The sheet of stock material was then cut and formed into a shallow cup in a conventional manner without the addition of any further lubricant or without any water. The cups with the layer of lubricant on the inner surface, were then reformed into finished containers in a conventional body maker where only water alone or water with 0.05% rust inhibitor were circulated through the tooling used in producing the finished container. Some containers were made using a water-emulsion oil mixture for the coolant.

Containers made from the organic ester preapplied sheets or coils consistently showed better cleanability when water alone was used as the coolant. In all instances the containers made without the emulsion oil lubricant had a smooth and uniform surface appearance.

EXAMPLE II

Aluminum stock material in the form of plates was coated on one side with an organic ester, such as the Mobil lubricant, to produce a layer on one surface having a distribution of approximately 1.25 mg./in.$^2$. These plates were then converted into cups and subsequently cans utilizing a commercially available cupper and a body maker. In converting the plates into cups, the plates were positioned so that the lubricated surface became the internal surface of the cup and no additional lubricant or water was needed to produce satisfactory cups from the plates. The cups were then converted to finished containers in the body maker utilizing only tap water. Several thousand of such cups and containers were produced and inspection of the finished containers showed that the containers had a shiny outside surface and a scratch-free inside surface. The containers were then cleaned using several standard cleaners with less than the present standard recommended concentration to remove all of the lubricants from the container surfaces.

EXAMPLE III

A coil of black plate stock material was cut into sheets and each of the sheets was coated on one surface with an organic coating and partially cured, as more fully described in copending application Ser. No. 851,859, filed Nov. 15, 1977, now abandoned, the portions of which are consistent with this disclosure being incorporated herein by reference. The respective sheets were then roll-coated with a thin layer (2.5 mg./in.$^2$) of a Mobil S-6651-003 lubricant on the other surface and the sheets were stacked and delivered to a commercial cupper. During this delivery some of the lubricant was transferred to the organic coated sides of the respective sheets.

Discs were then cut from the sheets and converted into shallow cups using commercial cupping equipment without the use of any water or additional lubricant. The shallow cups had the layer of lubricant on the inner surface and the organic coating on the outer surface. The cups were then converted into drawn and ironed containers in a commercial body maker. Some containers were formed from cups using only water as the cooling agent while other containers were formed using a lubricant-coolant. This lubricant-coolant was a water and emulsified oil mixture which included about 15% of a Texaco 591 emulsified oil. In all instances, the containers formed with water alone had as good or better surface appearance than those formed using the lubricant-coolant mixture.

It should be noted in this example that the thickness of the layer of lubricant was more than the desired thickness. This was because, with the commercial equipment available for conducting tests, it was not feasible to obtain a layer of less than 2 mg./in.$^2$.

The above tests establish that drawn and ironed containers can be formed from coated black plate, aluminum or tinplate by precoating the stock material with a thin layer of an organic ester lubricant and the drawn and ironed containers can be formed without the use of water or emulsifiable oils in the cupper and using only water as a coolant in the body maker or drawing and ironing machine.

It is believed that elimination of the water emulsion oils from the process and substitution of the organic ester results in a cost savings of approximately 50% in the lubricant alone and also provides additional savings in the use of milder cleaners and lower cleaning temperatures.

It has also been established that the organic ester lubricant provides better lubrication for the tooling than the water-lubricant mixture. This is believed to result from the fact that the lubricant is initially located directly between the tooling and the container surface interface and also from the fact that the organic ester lubricants withstand the temperatures encountered during ironing of the metal body without deterioration. Also, applying the layer of lubricant to the surface which becomes the inner surface of the container is believed to aid in stripping the ironed container from the punch.

Of course, if desired, both surfaces of the stock material could be coated with a lubricant and/or the distribution or thickness of the layer or layers could be increased. However, tests have shown that increasing the thickness of the coating on one surface only will not increase the efficiency of the operation but will increase the cost without any additional benefits. Respecting the two sided coating with lubricant, it was determined that the additional coating on the second side increased the costs without deriving any benefits from the increased cost. In other words, tests showed that one side coated material would have enough lubricant transferred to the other side during the processing of the stock material and in the cupper and body maker to eliminate the need for applying lubricant to the second side.

While the manner of applying the lubricant to the stock material is not critical in carrying out the present invention, the lubricant is preferably applied as the stock material is fed to the cupping machine. When the lubricant is applied to a stock material which also has an organic coating applied to one side, such as Example III, the coating and lubricant could simultaneously be applied to opposite sides of the stock material with a lubricator and the material could then be passed through an oven to partially cure the organic coating. It has been determined that the heating of the lubricant in the oven has no deleterious affect on the lubricant. Of course, the lubricant could also be applied in other ways. For example, it would be possible to apply the lubricant to the stock material in the cupping machine as the discs are being severed from the stock material and the appended claims are intended to cover such alternate method of application.

What is claimed is:

1. A method of forming a seamless drawn and ironed container having a bottom wall and an integral sidewall from a metal stock material, comprising the steps of applying a thin layer of a fatty acid ester lubricant in the range of about 1 to about 3 mg/in.$^2$ thickness equivalent to one surface of said metal stock material, converting said stock material into a cup, and forming a drawn and ironed container from said stock material in a multi-staged ironing process while retaining at least some of said lubricant on said surface throughout said ironing process.

2. A method as defined in claim 1, in which said metal stock material is tinplate.

3. A method as defined in claim 1, in which said metal stock material is aluminum.

4. A method as defined in claim 1, in which said metal stock material is a coil of stock material and in which said coil is unwound, said layer of lubricant is applied to one surface only of said stock material and said stock material is rewound so that some of said lubricant is transferred to the other surface of said stock material.

5. A method as defined in claim 1, in which said thin layer has a thickness of about 1.25 mg./in.$^2$.

6. A method as defined in claim 1, in which said lubricant is a fatty acid ester of a polyhydric alcohol.

7. A method as defined in claim 1, further including flowing a liquid coolant to the other surface of said metal stock while a drawn and ironed container is being ironed and in which said liquid coolant is devoid of any lubricant.

8. A method as defined in claim 1, in which said stock material initially has a disc removed therefrom and in which said disc is subsequently converted into a cup without any liquid coolant being supplied to said disc and said cup is subsequently formed into a drawn and ironed container.

9. A method as defined in claim 8, in which said one surface with said stock material is the inside of said cup.

* * * * *